US007591163B2

(12) United States Patent
Yamamoto

(10) Patent No.: US 7,591,163 B2
(45) Date of Patent: Sep. 22, 2009

(54) EXTRUSION MOLDING METHOD AND APPARATUS OF EXTRUSION PRESS

(75) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 0 days.

(21) Appl. No.: 11/729,914

(22) Filed: Mar. 29, 2007

(65) Prior Publication Data

US 2007/0227221 A1 Oct. 4, 2007

(30) Foreign Application Priority Data

Mar. 30, 2006 (JP) ..... 2006-093034
Mar. 30, 2006 (JP) ..... 2006-093035

(51) Int. Cl.
*B21C 25/04* (2006.01)
*B21C 27/04* (2006.01)

(52) U.S. Cl. ..... 72/273; 72/272

(58) Field of Classification Search ..... 72/270, 72/271, 255, 273.5, 254, 272, 273
See application file for complete search history.

(56) References Cited

U.S. PATENT DOCUMENTS 4,056,964 A * 11/1977 Shibasaki et al. ..... 72/273
4,165,625 A * 8/1979 Wagner et al. ..... 72/38
5,311,761 A * 5/1994 Robbins ..... 72/273
5,392,628 A 2/1995 Cristiani
5,445,004 A 8/1995 Nannini et al.
5,461,899 A 10/1995 Sørheim et al.
5,613,393 A 3/1997 Bessey
5,678,442 A 10/1997 Ohba et al.
5,896,772 A * 4/1999 Izumi ..... 72/272
5,918,498 A * 7/1999 Robbins ..... 72/273

FOREIGN PATENT DOCUMENTS

EP 0 097 115 A1 12/1983
EP 0 397 473 A1 11/1990
JP 10-128432 A 5/1998

* cited by examiner

*Primary Examiner*—Dana Ross
*Assistant Examiner*—Debra M Sullivan
(74) *Attorney, Agent, or Firm*—DLA Piper LLP (US)

(57) ABSTRACT

An extrusion molding method of an extrusion press includes a first step of loading a billet, the outer surface of which is subjected to a barking treatment, into a container, and extruding the billet in such a manner as to leave a predetermined length, a second step of loading a next billet into the container, additionally extruding the preceding billet with the succeeding billet in such a manner as to leave a predetermined length of the succeeding billet; and a third step of loading a next billet into the container and additionally extruding the preceding billet with the succeeding billet in such a manner as to leave a predetermined discard length of the succeeding billet and stopping extrusion. By way of these steps, the container does not move while maintaining contact with a die, and the billet is continuously extruded by leftover and additional extrusion.

1 Claim, 8 Drawing Sheets

(a)

(b)

EXTRUSION LEFTOVER LENGTH
(LENGTH BEFORE START OF WRAP-IN OF SURFACE SKIN LAYER)

(c)

(d)

(e)

(a)

(b)

EXTRUSION LEFTOVER LENGTH (DISCARD LENGTH)

(c)

(d)

(e)

EXTRUSION MOLDING METHOD AND APPARATUS OF EXTRUSION PRESS

BACKGROUND

1. Technical Field

This disclosure relates to an extrusion molding method of an extrusion press that exhausts air inside a container after a billet is loaded into the container when aluminum alloy or the like is extrusion molded by an extrusion press. More particularly, the disclosure relates to an extrusion molding method of an extrusion press that continuously extrudes a billet in succession to a preceding step. Furthermore, the disclosure relates to an improved extrusion molding apparatus for effectively and efficiently extruding a billet without entrapping air by the steps of closing the press by exhaust means detachable from the extrusion stem during extrusion molding of aluminum alloy, etc, by the extrusion press, simultaneously pushing a seal member disposed on the container side of the exhaust means to the container by a push device and exhausting air between the container and the billet before the billet is extruded.

2. Description of the Related Art

When aluminum alloy or the like is extrusion molded by an extrusion press, for example, a billet having a diameter smaller than an inner diameter of a container is first loaded into the container and is pushed into a die by an extrusion stem disposed at the back of the billet inside the container, or in other words, is subjected to so-called "upset". In this instance, the billet is crushed and air in the gap between the container and the billet is compressed. When exhaust of this compressed air outside the container is insufficient before extrusion of the billet, blisters occur in the resulting molding.

To overcome this problem, Japanese Unexamined Patent Publication (Kokai) No. 10-128432 describes a method for sucking and exhausting air by closing and sealing the gap between the container and the extrusion stem by split sealing means, advancing the extrusion stem to push the billet and sucking and exhausting air in the gap between the container and the billet before extrusion until upset is completed.

Extrusion molding of the prior art is carried out by the following method. To begin with, a billet cast and cut into a predetermined length is heated to a predetermined temperature by heating means such as a billet heater, and is loaded into a container in a state in which the billet is heated and its temperature is maintained. After air inside the container is exhausted, the billet is pressure fed forward by the extrusion stem. However, oxides and segregates of the outer peripheral portion of the billet and air are entrapped in the center portion of the billet on the contact surface of the billet with the extrusion stem when the billet is upset.

Therefore, to prevent the outflow of the oxides and the segregates to the extrusion molding, the extrusion molding operation is conducted in such a manner as to leave a predetermined length of unmolded portion and a discard and after the discard is discharged from the container and is cut, the next billet is loaded into the container and extrusion molding is continued.

Consequently, a non-extrusion time such as during an opening operation of the container till extrusion of a next billet, separation and cutting of the discard, etc, is extended and the efficiency of extrusion molding deteriorates.

Also, the container must be moved to remove the discard and it is difficult to maintain the positional accuracy of the container.

When a billet having a diameter a little smaller than an inner diameter of a container is loaded into the container and is pushed into a die by an extrusion stem disposed at the back of the billet inside the container, or in other words, when the billet is subjected to so-called "upset", the billet is crushed and air between the container and the billet is compressed. To vent the compressed air to the outside of the container from the side of a fix dummy block of the extrusion stem, a known exhaust apparatus has the following construction. Namely, a side end surface of a ring-like seal portion and an outer peripheral surface of the extrusion stem are allowed to simultaneously come into close contact with each other through the ring-like seal portion disposed on an end face of the container, into which a billet is loaded, on its extrusion stem side, a two-split seal block disposed in the direction crossing an axial direction of the extrusion stem, a seal member bonded to the contact surface of the seal block when the seal block is closed and a seal member disposed on the end face of the seal block on the extrusion stem side, and push means for pushing the seal member disposed on the end face of the seal block on the container side to the ring-like seal portion is disposed in such a manner as to be capable of moving in the axial direction of the extrusion stem. In the case of this construction, the above-mentioned patent document Japanese Unexamined Patent Publication No. 10-128432 describes a method of sucking exhaust air from a gap between the outer peripheral surface of the fix dummy block and the inner peripheral surface of the container while the inside of the container is sealed by the seal members.

According to the method of the prior art described above, the gap between the outer peripheral surface of the fix dummy block and the inner peripheral wall surface of the container is set so that the aluminum alloy can enter the gap between the outer peripheral surface of the fix dummy block and the inner peripheral wall surface of the container at the time of upset of the billet, but does not degrade the function of the fix dummy block, and the passage area for the exhaust can be sufficiently secured to suck air inside the container to achieve a predetermined degree of vacuum.

However, it is difficult to maintain constant the gap between the outer peripheral surface of the fix dummy block and the inner peripheral wall surface of the container because of the change with time of the gap owing to wear of the outer peripheral surface of the fix dummy block, the drop of a diameter-expanding function, adhesion of aluminum alloy dust from the container's inner peripheral surface to the outer peripheral surface of the fix dummy block, and so forth. Because the exhaust passage area changes, exhaust cannot be sufficiently conducted and variance occurs in the degree of vacuum inside the container.

It could therefore be advantageous to provide an extrusion molding method of an extrusion press that does not need to move a container and to cut and remove a discard whenever a billet is extruded, but can continuously extrude a plurality of billets by loading successively a next billet into the container and maintain stable container accuracy.

It could also be advantageous to prevent the occurrence of variance in the degree of vacuum inside a container, which variance occurs as an exhaust passage area cannot be secured and exhaust cannot be sufficiently conducted during exhaust extrusion molding by an extrusion press of aluminum alloy, or the like.

It could also be helpful to provide an extrusion molding apparatus that can conduct sufficient exhaust by securing a predetermined exhaust passage and eliminating variance in the degree of vacuum inside a container.

SUMMARY

To accomplish this, an extrusion molding method of an extrusion press using a gas exhausting step of sucking and removing air inside a container simultaneously with the start of upset for pushing a billet inside the container by using a billet, from which an oxide film and contamination on an outer surface are removed, includes the first step of loading the billet into the container, extruding the billet with the advance of an extrusion stem until a billet extrusion leftover length reaches a predetermined length, and stopping extrusion; the second step of loading a next billet into the container, additionally extruding the preceding billet with the succeeding billet with the advance of the extrusion stem until an extrusion leftover length of the succeeding billet reaches a predetermined length, and stopping extrusion; and the third step of loading a next billet into the container, additionally extruding the preceding billet with the succeeding billet with the advance of the extrusion stem until an extrusion leftover length of the succeeding billet reaches a predetermined discard length, and stopping extrusion; wherein the second step is conducted at least once after completion of the first step, and removal of the discard is conducted outside an extrusion molding apparatus after completion of the third step.

Because the method includes the step of using the billet from the outer peripheral surface of which the oxide film and contamination are removed, and sucking and removing air inside the container simultaneously with the start of upset before the billet inside the container is extruded, entrapment of the oxide and the segregates of the billet outer surface is less and the blisters do not occur in the extrusion molding.

The extrusion molding method includes the first step of loading a billet into a container, extruding the billet with the advance of an extrusion stem until a billet extrusion leftover length reaches a predetermined length, and stopping extrusion, and the second step of loading a next billet into the container, additionally extruding the preceding billet with the succeeding billet with the advance of the extrusion stem until an extrusion leftover length of the succeeding billet reaches a predetermined length, and predetermined discard length, and stopping extrusion, wherein the second step is conducted at least once after completion of the first step, so that a plurality of billets can be extruded successively and continuously. Consequently, the non-extrusion operations such as the opening operation of the container, the separation and cutting operations of the discard, etc. can be eliminated and extrusion molding efficiency as well as productivity of moldings can be drastically improved.

Because the opening operation of the container is not performed whenever a billet is supplied into the container, no change occurs in the axis between the container and the extrusion stem. Therefore, container accuracy can be stably maintained and seal performance between the extrusion stem and the container and exhaust performance can both be improved.

After the third step is completed, removal of the discard is conducted outside the extrusion press. Consequently, a shearing machine 50 (see FIG. 5(*d*)) has high freedom of arrangement and does not need be disposed on the top of the extrusion press apparatus, and thus the total height of the installation can be lowered. In other words, the installation can be assembled inside a building of low height.

In the extrusion molding method of the extrusion press, the extrusion leftover length of the billet is set to the length before wrap-in of the surface skin layer.

Because the extrusion leftover length of the billet is set to be equal to the length before wrap-in of the surface skin layer in the first and second steps, the billet surface skin layer is not wrapped into the center portion of the billet and even when the billet is continuously extruded, oxides of the billet surface layer and extrusion dust adhering to the inner peripheral surface of the container do not flow into the extrusion moldings. Because the extrusion leftover portion of the billet operates as a sealant on the die side, seal performance of the exhaust space inside the container can be improved and suction of air does not occur.

In the extrusion molding method of the extrusion press, the gas exhausting step causes a seal member to be pushed to an end face of the container on the side of the extrusion stem and to an outer peripheral surface of the extrusion stem after the billet is loaded into the container, and they are brought into close contact with each other to seal the container, sucks air inside the container from the side of the extrusion stem simultaneously with the start of upset, and finishes after exhaust is carried out to a predetermined degree of vacuum.

In the gas exhausting step, the seal member is pushed to the end face of the container on the side of the extrusion stem and to the outer peripheral surface of the extrusion stem after the billet is loaded into the container, and they are brought into close contact with each other to seal the container, air inside the container is sucked from the side of the extrusion stem simultaneously with the start of upset, and finishes after exhaust is carried out to a predetermined degree of vacuum. Therefore, it is possible to suck and remove air inside the container without allowing it to stay in the container, and thus achieve a sufficient degree of vacuum. As a result, an extrusion molding free from blister can be obtained and the production yield can be drastically improved.

In any of the extrusion molding methods of the extrusion press described above, removal of the oxide film and contamination on the outer peripheral surface of the billet is conducted by a cutting process or peeling means such as a scalper before the supply of the billet into the extrusion press or inside the extrusion press machine.

Since the removal of the oxide film and contamination on the outer peripheral surface of the billet is conducted by the cutting process or barking means such as a scalper before supply of a billet into the extrusion press or inside the extrusion press machine, bending of the billet in the longitudinal direction is small, dimensional accuracy of an outer diameter is excellent, and the gap between the billet and the container is small at the time of loading into the container. Therefore, the volume of the exhaust space is small and thus the exhaust time can be shortened.

Another aspect provides an extrusion molding apparatus equipped with exhaust means of a container having a seal member and seal means for sealing an end face of a container and an outer peripheral surface of an extrusion stem, comprising a fix dummy block capable of coming into close contact with an inner wall surface of the container and provided to a distal end of the extrusion stem; wherein the fix dummy block has at an axial distal end portion thereof an exhaust valve device including an outer ring, the distal end of which can expand in an outer radial direction, and a dummy core capable of moving in an axial direction while communicating with an exhaust passage inside the outer ring, and the exhaust passage communicates with the exhaust means.

As described above, the exhaust valve device is disposed at the axial distal end portion of the fix dummy block at the distal end of the extrusion stem and air inside the container is sucked and removed from the axial portion of the fix dummy block to the outer peripheral portion of the fix dummy block. Therefore, a predetermined exhaust passage area can be secured without being affected by changes over time of the peripheral portion of the fix dummy block and deposition of extrusion dust on the exhaust passage, exhaust can be sufficiently made and variance does not occur in the degree of vacuum.

Because of the provision of exhaust means capable of sealing the end face of the container and the outer peripheral surface of the extrusion stem by the seal member and the sealing means, seal of the container is sufficient, the degree of vacuum reached is high and exhaust can be made sufficiently.

The seal member keeps the end face of the container separated to avoid thermal influences from the outer peripheral surface of the extrusion stem until they come into mutual contact. Therefore, the service life of the seal material is long and seal performance can be stably maintained.

When the extrusion stem is moved back after the billet is extruded, the extrusion stem and the container are separated in order to prevent extrusion dust such as aluminum alloy scraped off by the outer peripheral surface of the fix dummy block from being deposited on the seal member. Therefore, high seal performance can be maintained for a long time.

Because exhaust can be sufficiently made and without variance inside the container, a high quality extrusion molding free from entrapment of air can be obtained.

The disclosure may be more fully understood from the description of preferred structures and methods, as set forth below, together with the accompanying drawings.

DETAILED DESCRIPTION

An extrusion molding method of an extrusion press will be hereinafter explained in detail with reference to FIGS. 1 to 4. In this connection, FIG. 5 shows a Comparative Example for the purpose of comparison with one of my extrusion molding methods of an extrusion press, but does not illustrate my extrusion molding method of the extrusion press.

Figure 1:
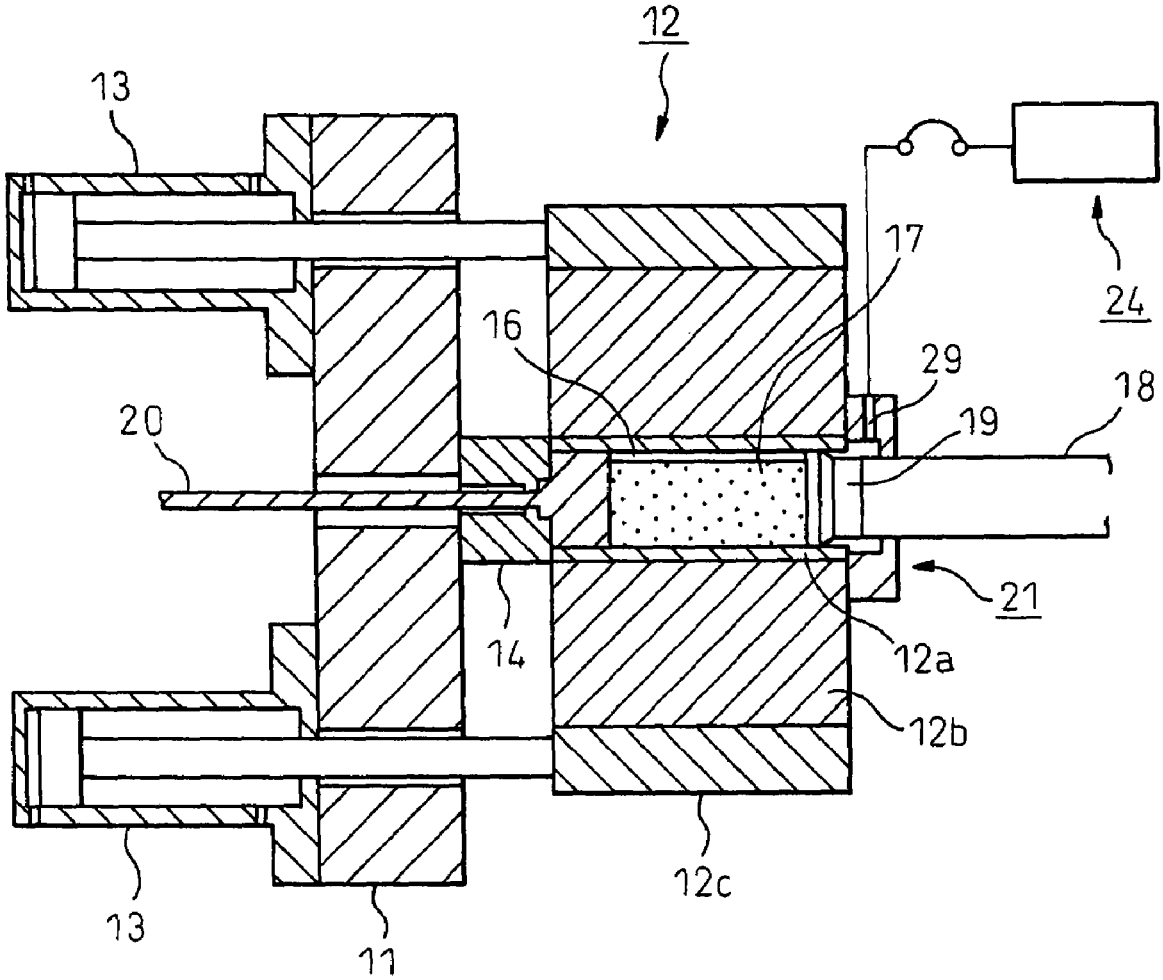
FIG. 1 is an explanatory view showing an outline of a suitable apparatus according to one structure.
Figure 2:
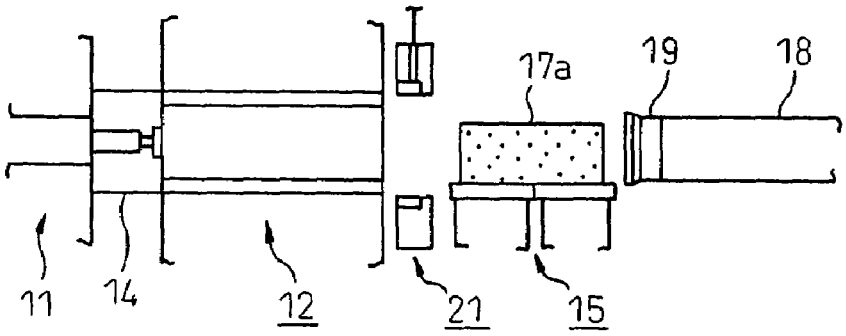
FIG. 2 is a flowchart for explaining operation states ((a) to (c)) with the passage of time.
Figure 2:
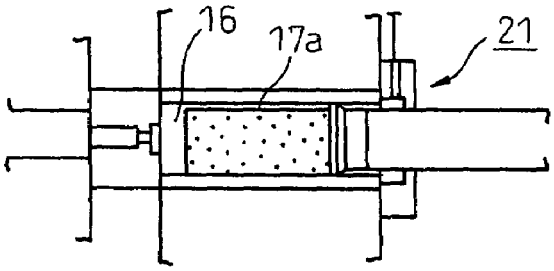
Figure 2:
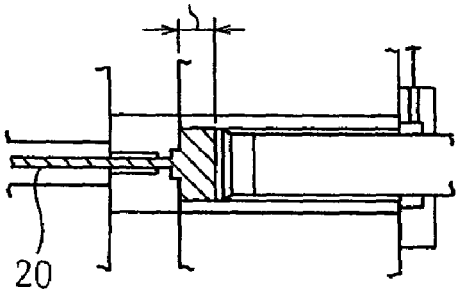
Figure 2:
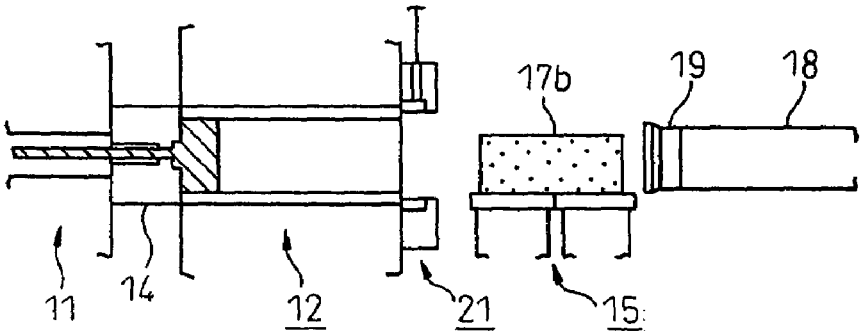
Figure 2:
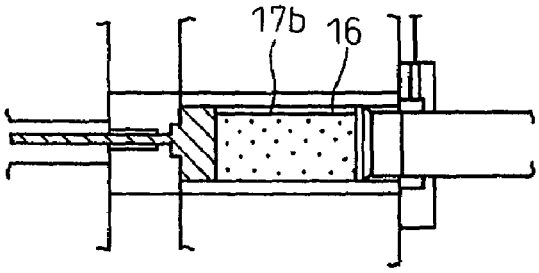
Figure 3:
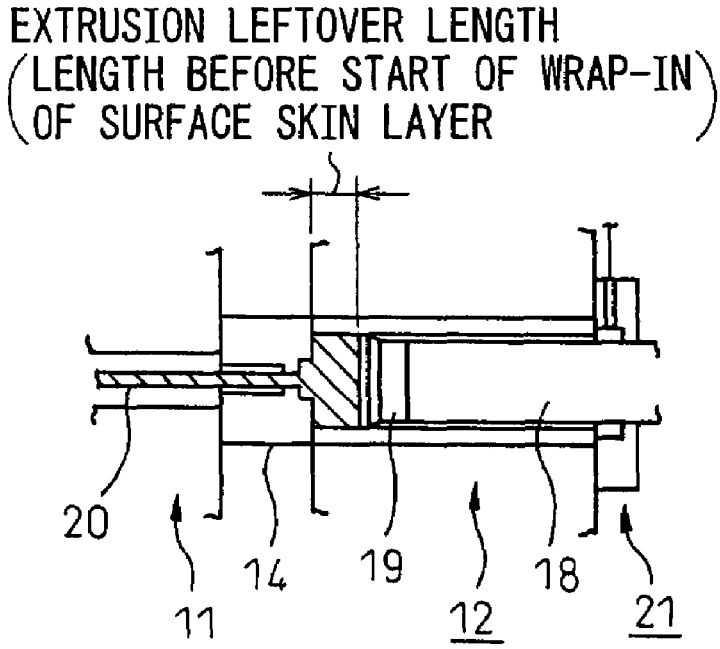
FIG. 3 is an explanatory view showing an extrusion leftover length in an extrusion stem stop state in first and second steps.
Figure 4:
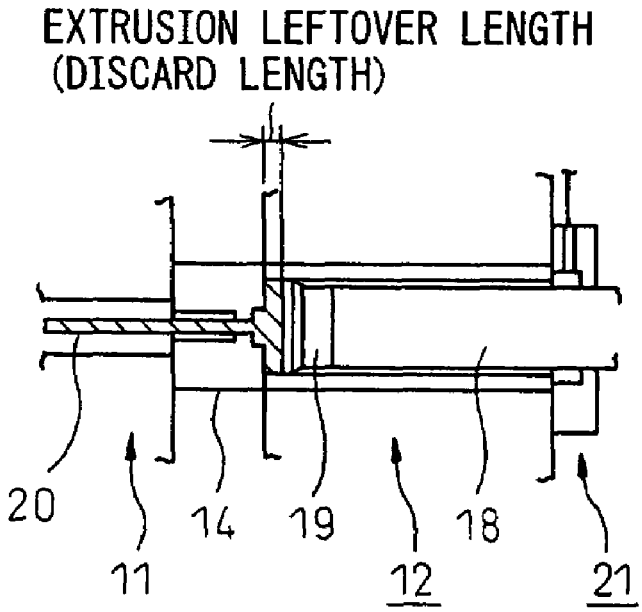
FIG. 4 is an explanatory view showing an extrusion leftover length in an extrusion stem stop state in a third step.
Figure 5:
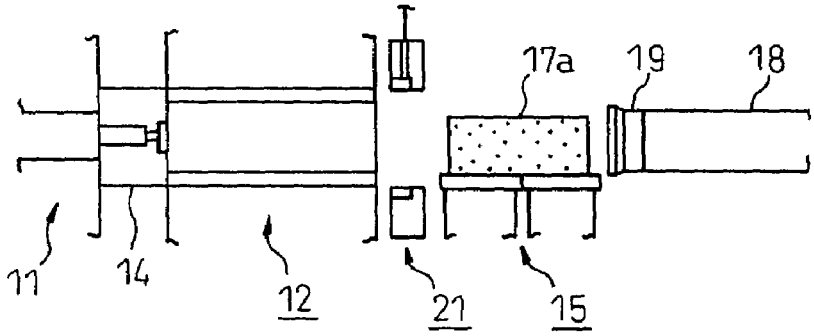
FIG. 5 is an explanatory view showing a Comparative Example for the purpose of comparison with an extrusion molding method of an extrusion press.
Figure 5:
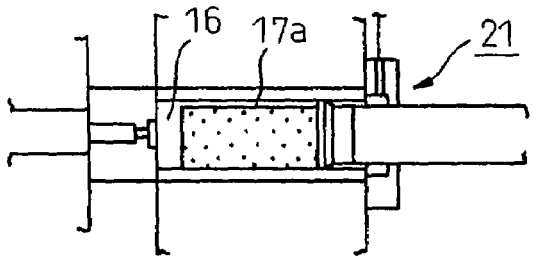
Figure 5:
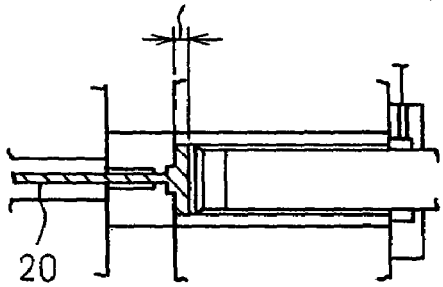
Figure 5:
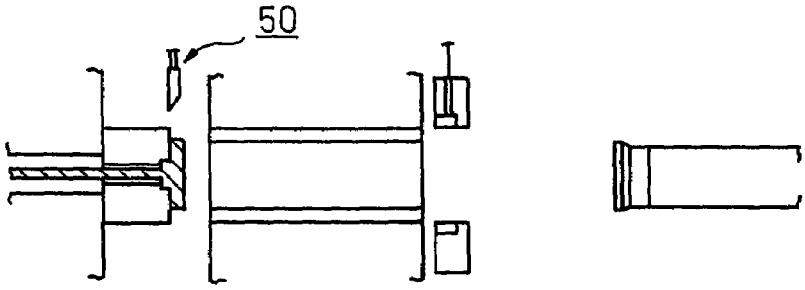
Figure 5:
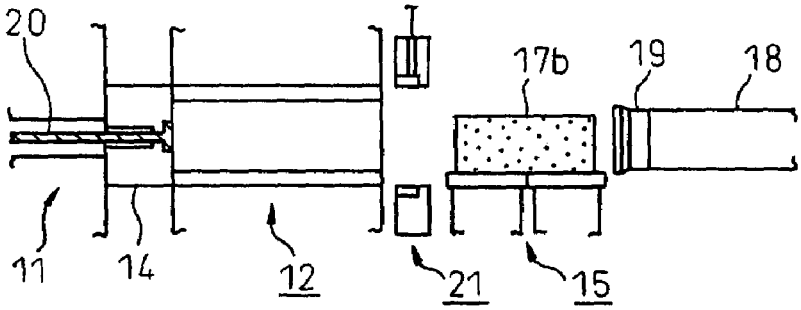

FIG. 1 is an explanatory view showing an outline of a suitable apparatus, FIG. 2 is a flowchart for explaining operation states with the passage of time, FIG. 3 is an explanatory view of an extrusion leftover length in an extrusion stop state in first and second steps and FIG. 4 is an explanatory view of an extrusion leftover length in an extrusion stop state in a third step.

In the construction of a suitable apparatus, container cylinders 13 for sliding containers 12 each including a container liner 12*a*, a container tire 12*b* and a container holder 12*c* are provided on an end platen 11 as shown in Fig 1. Each container cylinder 13 includes a piston, a piston rod, a cylinder tube, and so forth.

Reference numeral 14 denotes a die, and an outer peripheral surface of the die 4 is fitted to and held by an inner peripheral surface of a die ring, not shown in the drawing, in such a manner as to be capable of sliding. Reference numeral 16 denotes a gap between the inner peripheral surface of the container line 12*a* and an outer peripheral surface of a billet 17 that is peeled, and is an exhaust space. On the other hand, a fix dummy block 19 capable of coming into close contact with the inner surface of the container 12 is provided at the distal end of an extrusion step 18 that pushes the billet 17, the outer peripheral surface of which is peeled.

Reference numeral 21 denotes sealing means (exhaust means) of the end face of the container 12 on the extrusion stem side and the outer peripheral surface of the extrusion stem 18. The sealing means 21 is arranged in such a manner that it is allowed to freely slide in a direction of an extrusion axis and a direction crossing the extrusion axis direction and to be capable of pushing by driving means which is divided into at least two parts and is not shown in the drawing. The end face of the container on the extrusion stem side and the outer peripheral surface of the extrusion stem 18 are sealed by a sealant, not shown in the drawing, to hermetically seal the inside of the container 12.

Reference numeral 24 denotes suction means for sucking and removing air from the side of the extrusion stem 18 inside the container 12. The suction means 24 includes a vacuum pump, a vacuum tank, a solenoid valve, and so forth that are not shown in the drawings. Reference numeral 20 denotes an extrusion member which the peeled billet 17 is crushed with the advance of the extrusion stem 18 and is extruded from the die 14. The seal means (exhaust means) 21 has an air discharge passage 29 communicating the exhaust space 16 and the suction means 24.

Next, the extrusion molding method of the extrusion press will be explained.

Pressure oil is supplied to the rod side of the container cylinder 13, the piston rod is activated to move in a contracting direction, and the container 12 and the die 14 are brought into contact with each other, as shown in FIG. 2. Next, while the forward billet 17*a* is being placed, the billet loader 15 moves up and holds the forward billet 17*a* at the extrusion center position (FIG. 2(*a*)), and the extrusion stem 18 is moved forth and pushes the billet 17*a* into the container 12. The advance of the extrusion stem 18 is once stopped while the forward billet 17*a* is pushed into the container 12, and the seal means 21 is operated to push the end face of the container 12 on the extrusion stem side and the outer peripheral surface of the extrusion step 18, to thereby seal the container 12 and to communicate the suction means 24 with the exhaust space 16 inside the container 12 (FIG. 2(*b*)).

The suction means 24 is operated simultaneously with sealing of the container 12 so that suction and discharge of air inside the exhaust space 16 are carried out and re-advance of the extrusion stem 18 that was stopped beings again. The forward billet 17*a* loaded into the container 12 is pushed due to the re-advance of the extrusion stem 18 while the distal end is restricted, and is crushed by the die 14. Air inside the exhaust space 16 flows through the gap between the inner peripheral surface of the container and the outer peripheral surface of the fix dummy block and is sucked and discharged outside the container 12 by the suction device 24 through the air passage 29 of the seal means 21. When a vacuum inside the container 12 reaches a predetermined level, the sucking operation is stopped and the exhaust step is completed.

As the extrusion stem 18 moves to the forefront, the exhaust space 16 inside the container 12 is filled with the forward billet 17*a*, and upset is completed by detecting a predetermined extrusion stem re-advance pressure. Next, the extrusion stem 18 controlled to a desired extrusion speed and a desired extrusion pressure moves forth, extrudes the extrusion material 20, detects that the billet size reaches a predetermined extrusion leftover length (length before the start of rollup of a surface skin layer) and stops extrusion, thereby to complete the first step (FIG. 2(*c*)).

When extrusion stops, the extrusion stem 18 is moved back to the position at which a succeeding billet 17*b* can be held at the extrusion center position and then the billet loader 19 having thereon the succeeding billet 17*b* moves up (FIG. 2(*d*)). Next, the extrusion stem 18 is moved forth to push the succeeding billet 17*b* into the container 12, the container 12 is sealed by the seal means (FIG. 2(*e*)), and the leftover portion of the forward billet 17*a* and the succeeding billet 17*b* are together extruded to continuously repeat the second step shown in FIGS. 2(*d*) and 2(*e*).

The second step is completed in the quantity corresponding to the balance obtained by subtracting 1 from a predetermined number of extrusion moldings and in the third step, the leftover is set to a predetermined discard length and extrusion is stopped (FIG. 4). The pressure oil is thereafter supplied to the container cylinder 13 on the piston chamber side 13 to separate the container 12 from the die 14. Next, while discard is applied to the die 14, the billet is slid out from the extrusion press machine and after the discard is cut and removed, the extrusion press operation is completed.

Incidentally, an oxide film is formed on the surface skin layer even in the case of a billet subjected to barking before loading into the container as it is heated and held inside the container. On the other hand, the friction resistance inside the billet material at the time of extrusion is lower than the resistance of the contact surface between the billet surface skin layer and the container. Since the flow on the billet surface skin layer is slower than in the material at the center, the billet outer skin (oxide film) is wrapped into the contact surface with the extrusion stem when the extrusion leftover length of the billet becomes small. Therefore, in the first and second steps, extrusion is carried out until the extrusion leftover length of the billet is equal to the length before the start of wrap-in of the surface skin layer and the extrusion stem is then stopped. In this way, wrap-in of the oxide film and the outflow to the extrusion material described above are prevented.

In the third step in which extrusion is completed, extrusion is carried out until the leftover length of the billet reaches the discard length as shown in FIG. 4, and then the extrusion stem is stopped to prevent outflow of the oxide film to the extrusion material and to improve the production yield of the billet.

Suction and discharge of air inside the exhaust space 16 in the exhaust step described above are carried out by operating the vacuum pump in advance to bring the vacuum tank to a vacuum of 0 to 5 Torrs and operating the solenoid valve as soon as the suction means 24 and the exhaust space 16 communicate with each other. In this case, the container 12 is preferably brought into a vacuum state of 5 to 30 Torrs in the course of 0.2 to 0.5 seconds when suction is started. In the explanation hereby given, the solenoid valve is operated simultaneously with the communication of the suction means 24 with the exhaust space 16. However, it is also possible, for example, to employ an air discharging method that starts suction by operating the solenoid after sealing by the seal means 21 is completed and a predetermined time passes.

FIGS. 2(*a*) and 2(*d*) show the construction in which the billet loader 15 for supporting thereon the billets 17*a* and 17*b* and keeping them at the extrusion positions is arranged between the container 12 and the extrusion stem 18 by moving the extrusion stem 18 back in the direction of the extrusion axis. However, it is also possible to employ a construction in which the extrusion stem 18 is moved in the vertical direction to the extrusion axis after it is pulled out from the container 12, the billet loader moves into the space from which the extrusion stem has moved away and loading of the billets 17*a* and 17*b* into the container 12 is conducted by conveyor means provided to the billet loader.

The oxide film and the contamination of the outer surface of the billet used in the embodiment described above can be removed by peeling means such as cutting, a scalper, etc, before the supply of the billet to the extrusion press, or inside the extrusion press machine. The formation of the oxide film on the billet surface due to heating by the billet heater is slight. It is also possible to supply the billet, the outer surface of which is processed in advance into the billet heater, and to remove it before loading of the extrusion press into the container.

Since the billet after its outer surface is processed by the barking means has a small curve in the longitudinal direction and is excellent in its outer dimensional accuracy, the diameter gap with the container at the time of loading of the billet into the container can be reduced. For example, an outer size of an as-cast billet according to the prior art that can be loaded into a container having an inner diameter of 185 mm is 178 mm and the diameter gap with the container is 7 mm. On the other hand, a billet having an outer size of 182 mm can be loaded, the diameter gap with the container is 3 mm and the exhaust space capacity can thus be reduced by about 60% in comparison with the prior art. Therefore, the exhaust time of the exhaust space and the upset time of the billet can be shortened and the degree of exhaust vacuum can also be improved.

The sealing means of the container and the extrusion stem brings the side end surface of a ring-like seal portion and an outer peripheral surface of the extrusion stem into close contact with each other through the ring-like seal portion disposed on an end face of the container, into which the billet is loaded, on its extrusion stem side, a two-split seal block adapted in such a manner as to be capable of being opened and closed in a direction crossing the axial direction of the extrusion stem, a seal member bonded to a contact surface of the seal block when it is closed, a seal member disposed on the end face of the seal block on the extrusion stem side and a seal member disposed on the end face of the seal block on the extrusion stem side, and push means for pushing the seal member disposed on the end face of the seal block on the container side to the ring-like seal portion is preferably disposed in such a manner as to be capable of moving in the axial direction of the extrusion stem.

The extrusion molding method described above includes the first step of loading the billet into the container, extruding the billet till the extrusion leftover length of the billet reaches a predetermined length with the advance of the extrusion stem, and stopping extrusion; the second step of loading the next billet into the container, extruding additionally the preceding billet with the advance of the extrusion stem till the extrusion leftover length of the succeeding billet reaches a predetermined length and stopping extrusion and the third step of loading the next billet into the container, extruding additionally the preceding billet with the advance of the extrusion stem till the extrusion leftover length of the succeeding billet reaches a predetermined discard length and stopping extrusion, wherein the second step is carried out at least once after the first step is completed. Accordingly, the minimum number of continuous extrusions is three. However, when a predetermined number of continuous extrusions is set to 2 smaller than 3, extrusion is completed by extrusion of the third step after the first step by omitting the second step.

As is obvious from the explanation given above, the extrusion molding method uses a billet, the outer surface of which is subjected to peeling treatment, discharges air inside the container simultaneously with upsetting, extrudes the preceding billet in such a manner as to leave the un-extruded portion, loading the succeeding billet by holding the container and conducting additional extrusion. Therefore, the succeeding billet can be continuously extruded in succession to previous extrusion and extrusion molding efficiency as well as productivity can be drastically improved. Because a high degree of vacuum can be achieved inside the container by the sealing means and the suction means and exhaust can be sufficiently conducted, an extrusion molding free from blisters can be obtained, and the production yield can also be improved.

An extrusion molding apparatus will be explained in detail with reference to FIGS. 6 to 8. FIG. 9 shows a Comparative Example for the purpose of comparison with my extrusion molding apparatus, and does not represent that structure.

Figure 6:
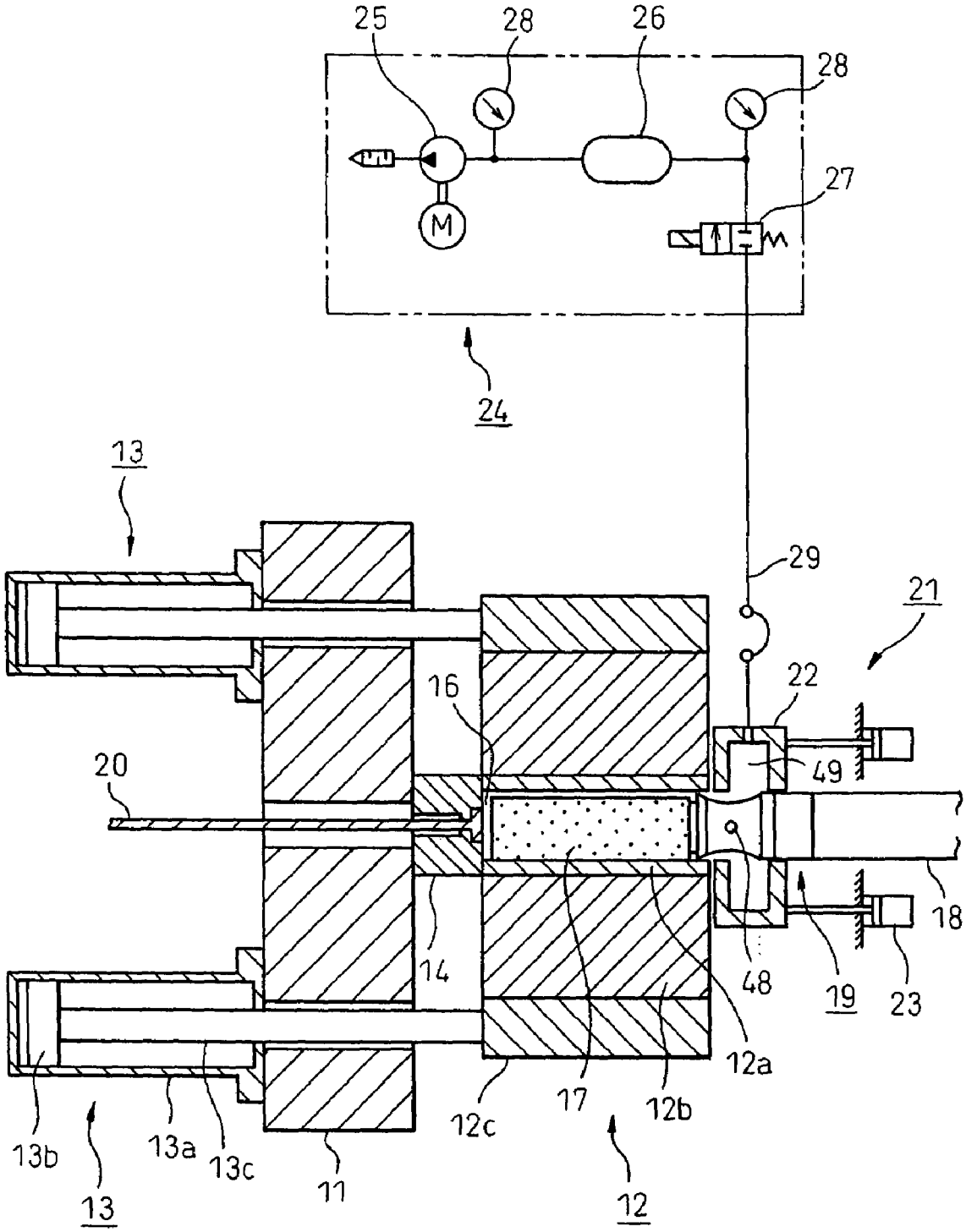
FIG. 6 is an explanatory view showing an outline of an extrusion molding apparatus.
Figure 7:
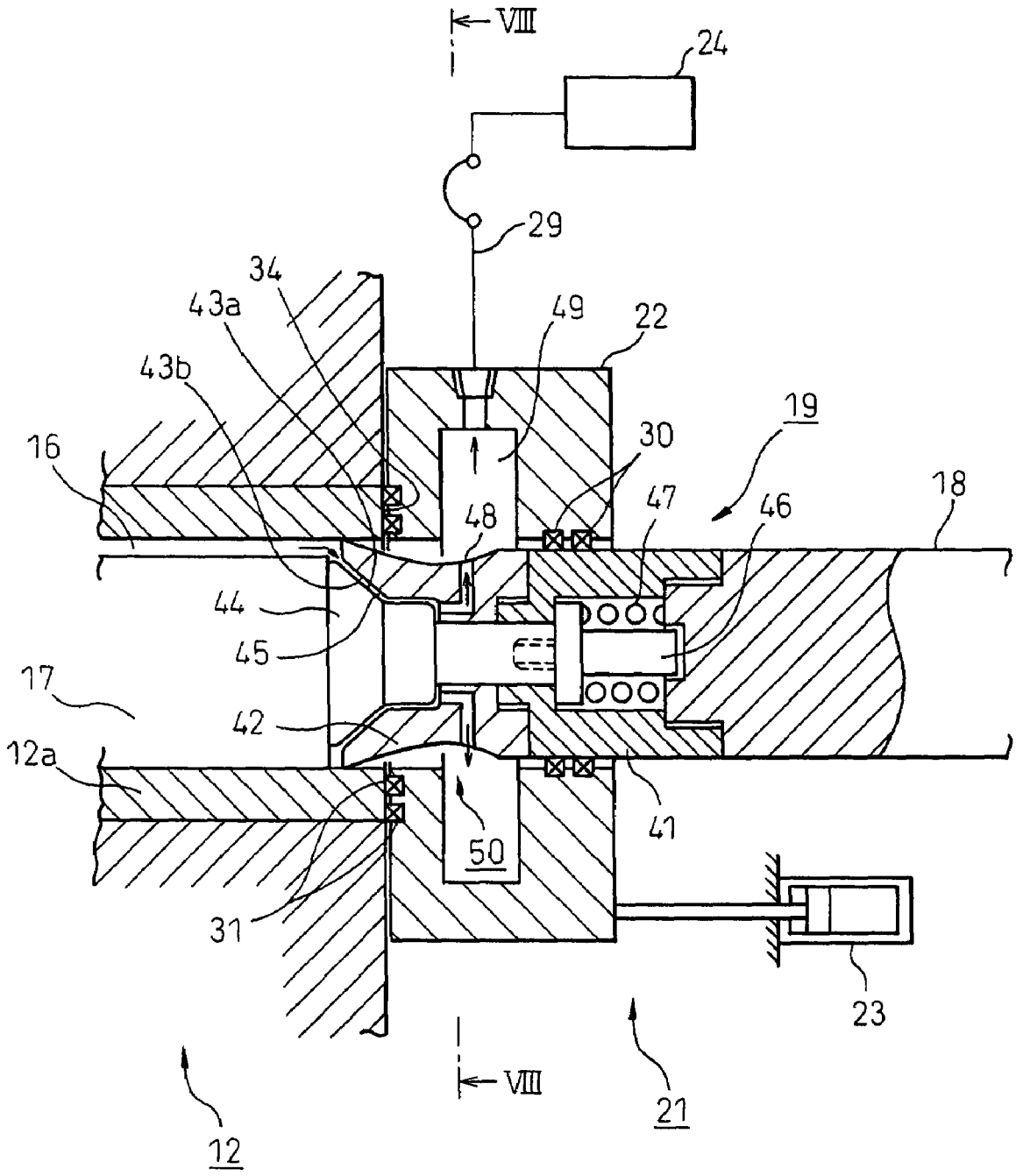
FIG. 7 is an enlarged view of principal portions of FIG. 6.

FIG. 6 is an explanatory view showing an outline of the extrusion molding apparatus, FIG. 7 is an enlarged view of principal portions of FIG. 6, and F*ig*. 8 is a sectional view taken along line VIII to VIII of FIG. 7.

As shown in FIG. 6, a container cylinder 13 for sliding a container 12 that includes a container line 12*a*, a container tire 12*b* and a container holder 12*c* is arranged on the side of an end platen 1. Reference numeral 13*a* denotes a cylinder tube constituting a part of the main body of the container cylinder 13, reference numeral 13*b* denotes a piston, and reference numeral 13*c* denotes a piston rod.

Reference numeral 14 denotes a die, which is fitted to, and held by, a die ring, not shown, in such a manner that the outer periphery of the die 14 can slide on an inner peripheral surface of the die ring. Reference numeral 16 denotes a gap between the inner peripheral wall surface of the container line 12*a* and the outer peripheral surface of the billet 17, and this gap being an exhaust space also. A fix dummy block 19 capable of coming into close contact with the inner peripheral wall surface of the container liner 12*a* is disposed at the distal end of an extrusion stem 18 for pushing the billet 17.

Reference numeral 20 denotes an extrusion member extruded from the die 14 as the billet 17 is crushed with the advance of the extrusion stem 18.

The exhaust means (sealing means) 21 for sucking and removing compressed air inside the exhaust space 16 in this embodiment will now be explained.

The exhaust means 21 for sucking and removing air from the extrusion stem 18 side inside the container 12 includes a two-split seal block 22 arranged on the end face of the container 12 on the extrusion stem side and so constituted as to be capable of being opened and closed in a direction crossing an axial direction of the extrusion stem 18. When closed, the seal block 22 is brought into close contact with the contact surface 35 and the outer peripheral surface of the extrusion stem 18, moves in the axial direction of the extrusion stem 18, brings the seal block into close contact with the container end face and seals the container 12. Reference numeral 23 denotes a push device for moving and pushing the seal block 22 in the axial direction of the extrusion stem 18 of the seal block 22.

The exhaust means 21 has a vacuum suction device (suction means) 24. The vacuum suction device 24 includes a vacuum pump 25, a vacuum tank 26, a solenoid valve 27, a vacuum gauge 28*a*, and so forth, and communicates with the exhaust space 16 through the exhaust means 21 and piping arrangement 29 when the container 12 is sucked and exhausted.

Figure 8:
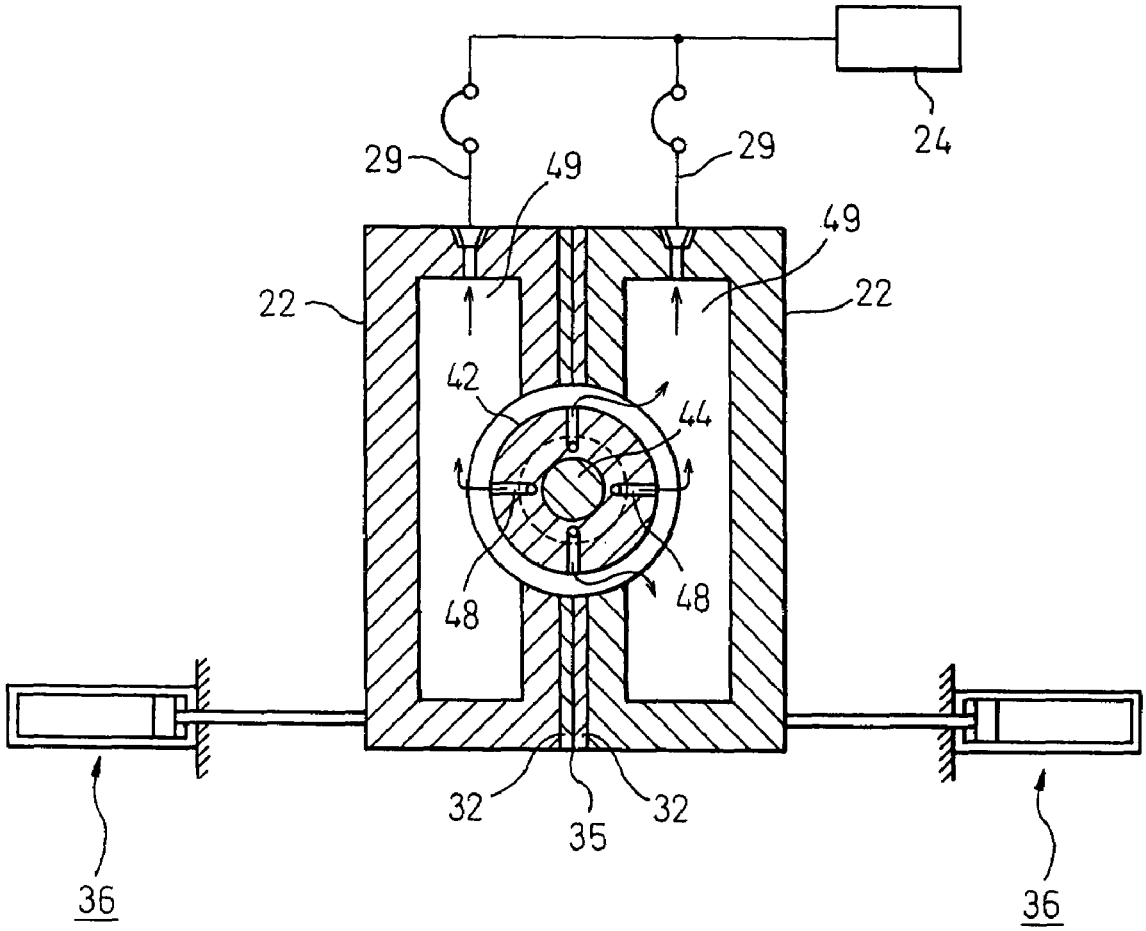
FIG. 8 is a sectional view taken along line VIII to VIII of FIG. 7.
Figure 9:
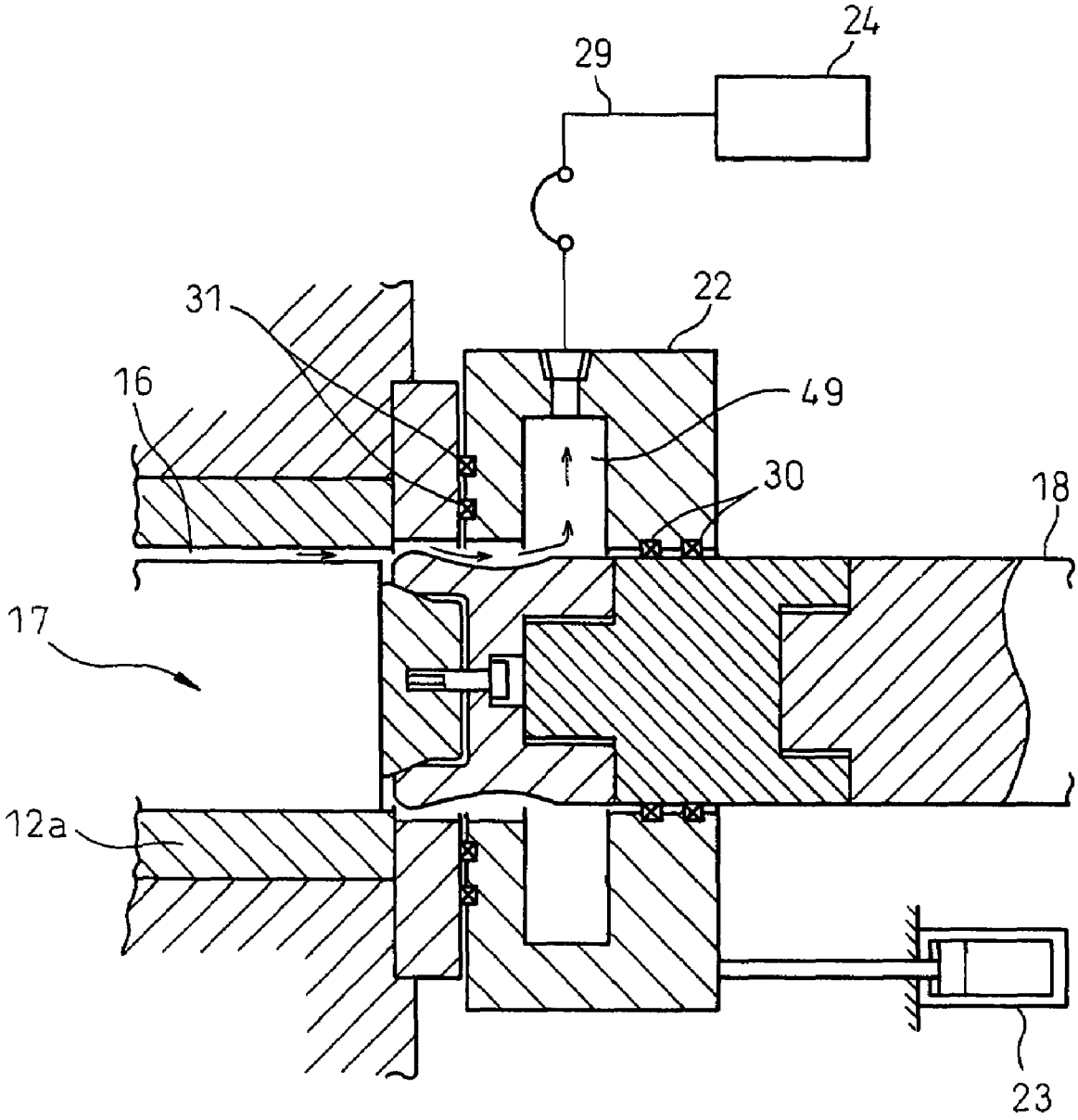
FIG. 9 is an explanatory view showing a Comparative Example for the purpose of comparison with my extrusion molding apparatus.

As shown in FIGS. 7 and 8, the seal block 22 includes a seal member 30 that moves in the direction crossing the axial direction of the extrusion stem 18 and comes into close contact with the extrusion stem 18 or the outer peripheral surface of the fix dummy block 19 for sealing, a seal member 31 that moves in the axial direction of the extrusion stem 18, comes into close contact with a ring-like seal member 34 on the end face of the container end face side for sealing, and a seal member 32 that comes into close contact with the contact surface 35 for sealing when the seal block 22 is closed. Reference numeral 36 denotes an opening/closing device for moving the seal block 22 in the direction crossing the axial direction of the extrusion stem 18.

Among the seal members 30, 31 and 32 described above, the seal members 30 and 31 are preferably formed preferably formed of a material that is relatively hard, has heat resistance, such as silicon rubber or fluoro-rubber, and is processed into a string form, whereas the seal member 32 is preferably formed of a heat resistant material such as a sheet of a sponge form of a silicon rubber, fluoro-rubber, etc. Incidentally, each of the seal members 30 and 31 is formed by arranging two seal materials double in the spaced-apart relation as shown in FIG. 7 in order to prevent entry of external air at the time of exhaust, although the disclosure is not limited to this particular construction. In other words, three or more rows of the seal materials may be preferably arranged in order to maintain the degree of vacuum reached.

Next, the fix dummy block 19 disposed at the distal end of the extrusion stem 18 will be explained.

As shown in FIG. 7, the fix dummy bock 19 includes a connecting rod 41 meshing with a screw formed at the distal end portion of the extrusion stem 18, a drum-shaped outer ring 42 meshing with a screw formed at the distal end portion of the connecting rod 41 and having its distal end portion expanding in an outer diametric direction and capable of coming into close contact with the inner peripheral surface of the container 12, a dummy core 44 having at its distal end portion a taper-like valve seat 43*a* positioned at an axial portion inside the outer ring 42 and the connecting rod 41, and forming a ring-like space as an exhaust passage 45 with the outer ring 42, and an adaptor 46 fitted by a screw to the dummy core 44 inside the connecting rod 41.

In an exhaust valve device 50 constituted by the outer ring 42 and the dummy core 44, the inner surface of the outer ring 42 has a taper-like valve seat 43*b* as shown in the drawing and the valve seats 43*a* and 43*b* abut each other to thereby close the ring-like exhaust passage 45. A plurality of outer ring exhaust passages 48 are disposed at a substantial center of the drum-shape of the outer ring 42 and communicate with the ring-like exhaust passage 45.

The exhaust valve device 50 is normally open due to the operation of an elastic body 47 inside the connecting rod 41, and the reaction of the billet 17 at the time of extrusion acts on the dummy core 44 and closes the exhaust valve device 50. The exhaust passage 45 of the exhaust valve device 50 communicates with the vacuum suction device 24 through a plurality of outer ring exhaust passages 48 and the seal block exhaust passage 49.

As described above, this example employs a construction in which the reaction of the billet 17 at the time of extrusion brings the taper-like valve seat 43*a* of the dummy core 44 into contact with the taper-like valve seat 43*b* of the outer ring 42 to thereby cut off the exhaust passage 45. Therefore, the distal end portion of the outer ring 42 expands toward the outer periphery and can come into close contact with the inner peripheral surface of the container 12. The distal end surface of the dummy core 44 is allowed to protrude slightly more than the distal end surface of the outer ring 42. This construction is intended to prevent the distal end surface of the outer ring 42 from striking the end face of the billet 17 on the extrusion stem side as soon as the billet 17 is extruded, and render the exhaust operation easy and reliable.

Next, the extrusion operation of the extrusion molding apparatus will be explained.

As shown in FIG. 6, the pressure oil is first supplied to the rod chamber 13*c* of the container cylinder 13, the piston 13*b* is moved in the extruding direction and the die 14 and the container 12 are brought into contact with each other. Next, the billet loader supporting thereon the billet 17, and not shown in the drawing, moves up and when the extrusion stem 18 is moved forth, the billet 17 is pushed into the container 12. The advance of the extrusion stem 18 is stopped in the state in which the end face of the billet 17 on the extrusion stem side is pushed more inward than the end face of the container on the extrusion stem side. The exhaust means 21 is then operated to communicate the exhaust space 16 as the gap between the container 12 and the billet 17 with the vacuum suction device 24.

After the seal block 22 is closed by operating the opening/closing device 36 as shown in FIGS. 7 and 8, the extrusion device 23 is operated to push the seal block 22 in the closed state to the ring-like seal portion 34 of the container 12 on the extrusion stem side. As a result of these operations, the contact surface 35 of the seal block 22, the outer peripheral surface of the extrusion stem 18 and the end face of the container 12 on the extrusion stem side are sealed by the seal members 30, 31 and 32, respectively, and the container 12 is closed. Air inside the exhaust space 16 is exhausted as the vacuum suction device 24 is operated.

Discharge of air inside the exhaust space 16 is performed by the vacuum suction device 24 through the end face gap between the billet 17 and the outer ring 42 of the fix dummy block 19, the taper-like ring-like gap between the outer ring 42 and the dummy core 44, the ring-like exhaust space 45, a plurality of outer ring exhaust passages 48, the seal block exhaust passage 49 and the piping arrangement 49.

The timing of actuation of the vacuum suction device 24, i.e. the start of the exhaust operation, may be at any time before the start of upset after loading of the billet 17 into the container 12, simultaneously with the start and after the passage of a predetermined time after the start of upset. A suitable start timing is selected in accordance with various extrusion conditions. The exhaust operation is completed by detecting the exhaust space 16 reaching a predetermined degree of vacuum.

After completion of upset of the billet 17 is detected, extrusion starts with the advance of the extrusion stem 18 and the extrusion member 20 is pushed out from the die 14.

When the predetermined degree of vacuum is detected by the exhaust means 21 and the vacuum suction device 24 stops operating, the extrusion device 23 and the opening/closing device 36 are operated and moved back to the backward limit positions, respectively, and enter the stand-by state for the next operation. The extrusion operation is thereafter continued as such and extrusion of the extrusion member 20 is conducted. When extrusion is completed while the billet of a predetermined discard size is left, the extrusion stem 18 is moved back and the discard is separated and cut off from the container 12 to enter the next cycle. Here, the term "advance" of the extrusion stem 18 means the direction of entry into the container 12, and the term "move back" means the operation leaving the container 12.

As explained above, the sealing means of the container and the air discharge means are provided and air inside the container is sucked and removed from the passage inside the extrusion stem by the discharge valve device disposed at the axis portion of the distal end of the fix dummy block and the vacuum suction device. Therefore, the extrusion molding apparatus can execute a sufficient exhaust operation by securing the predetermined exhaust passage area, and unevenness of the degree of vacuum inside the container that results from the change of the outer peripheral surface of the fix dummy block with elapsed time does not occur.

The sealing means (exhaust means) of the container and the extrusion stem bring the side end surface of the ring-like seal portion and the outer peripheral surface of the extrusion stem into close contact with each other through the ring-like seal portion disposed on the end face of the container, into which the billet is loaded, on its extrusion stem side, the two-split seal block provided in such a manner as to be capable of being opened and closed in the direction crossing the axial direction of the extrusion stem, the seal member bonded to the contact surface of the seal block when it is closed, the seal member disposed on the end face of the seal block on the extrusion stem side, and the push means for pushing the seal member disposed on the end face of the seal block on the container side to the ring-like seal portion is preferably disposed in such a manner as to be capable of moving in the axial direction of the extrusion stem. The exhaust means has a high degree of vacuum achieved and can sufficiently execute the exhaust operation.

According to the construction which makes it easy to exchange the seal material by bonding, a time for exchanging the seal member becomes short and productivity is not lowered.

While my apparatus and methods have been described by reference to specific examples chosen for purposes of illustration, it should be apparent that numerous modifications can be made thereto by those skilled in the art without departing from the basic concept and scope of the disclosure.

The invention claimed is:

1. An extrusion molding apparatus equipped with exhaust means for a container having a seal member and seal means for sealing an end face of a container and an outer peripheral surface of an extrusion stem, comprising:

a fix dummy block located on a distal end of said extrusion stem and comprising:

1) a connecting rod meshing with a distal end portion of the extrusion stem, a drum-shaped outer ring meshing with a distal end portion of a connecting rod and having its distal end portion expanding in an outer diametric direction and closely contacting an inner peripheral surface of the container, a dummy core extending inside an axial portion of the outer ring and the connecting rod, having at its distal end portion a tapered valve seat and forming a ring-shaped space as an exhaust passage with the outer ring, and an adaptor meshing with the dummy core inside the connecting rod;

2) an exhaust valve device comprising the outer ring and the dummy core that is normally open due to operation of an elastic body placed in a space inside the connecting rod and when reaction of a billet at the time of extrusion acts on the dummy core, the exhaust valve device is closed; and 3) the space for putting the elastic body inside the connecting rod is away from a plurality of outer ring exhaust passages, which are formed on the outer ring and communicate with the ring-shaped exhaust passage formed between the dummy core and the outer ring, and does not communicate with the outer ring exhaust passages and the first ring-shaped exhaust passage.

* * * * *